US007402080B2

(12) United States Patent
Xiao et al.

(10) Patent No.: US 7,402,080 B2
(45) Date of Patent: Jul. 22, 2008

(54) ELECTRICAL CONNECTOR FOR RELIABLY MOUNTED ON A PRINTED CIRCUIT BOARD

(75) Inventors: Xue-Yuan Xiao, Kunshan (CN); Guo-Hua Zhang, Kunshan (CN); Jin-Kui Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/657,257

(22) Filed: Jan. 24, 2007

(65) Prior Publication Data

US 2007/0173119 A1 Jul. 26, 2007

(30) Foreign Application Priority Data

Jan. 24, 2006 (CN) ..... 2006 2 0068939

(51) Int. Cl.
*H01R 13/648* (2006.01)

(52) U.S. Cl. ..... 439/607

(58) Field of Classification Search ..... 439/607, 439/79, 108

See application file for complete search history.

(56) References Cited

U.S. PATENT DOCUMENTS 5,755,595 A * 5/1998 Davis et al. ..... 439/607
5,993,258 A 11/1999 Matsunuma
6,475,033 B1 11/2002 Zhu
6,986,681 B2 * 1/2006 Tsai ..... 439/607
7,165,989 B2 * 1/2007 Huang et al. ..... 439/607
7,258,565 B2 * 8/2007 Huang et al. ..... 439/353
2005/0048840 A1 * 3/2005 Zhang ..... 439/607
2005/0282424 A1 * 12/2005 Huang et al. ..... 439/353

* cited by examiner

*Primary Examiner*—Hae Moon Hyeon
(74) *Attorney, Agent, or Firm*—Wei Te Chung

(57) ABSTRACT

An electrical connector (100) includes an insulative housing (1) defining a number of passageways (121) for receiving corresponding contacts (2), and a metal shield (3) enclosing the insulative housing (1). The metal shield has a top face (31), a bottom face (32) and a pair of side faces (33). The bottom face includes a pair of first board mounting legs (325) downwardly and a slot (326) between the first board mounting legs (325). The first board mounting legs (325) are disposed in communication of the slot (326) and mounted on a printed circuit board (4). The length of the slot (326) is equal to the total length of the first board mounting legs (325). With the addition of the first board mounting legs (325), the connector (100) can be more stably mounted on the printed circuit board.

14 Claims, 5 Drawing Sheets

ELECTRICAL CONNECTOR FOR RELIABLY MOUNTED ON A PRINTED CIRCUIT BOARD

BACKGROUND OF THE INVENTION

1. Field of the Invention

This invention generally relates to an electrical connector, and more particularly to an electrical connector which can be stably mounted on a printed circuit board (PCB).

2. Description of the Prior Art

U.S. Pat. No. 5,779,489, discloses a conventional electrical connector which includes an insulative housing, a plurality of contacts retained in the insulative housing and a metal shield enclosing the insulative housing. The metal shield defines a pair of side walls and a couple of board mounting legs respectively extending downwardly from the side walls. The electrical connector is mounted on a PCB solely by way of its two board mounting legs that are positioned at the end of the electrical connector. Such a mounting arrangement does not provide strong resistance to external forces that occur when a mating connector is inserted into or removed from the electrical connector. Because this electrical connector is mounted only at its rear portion, the open end of the electrical connector, is in effect, cantilevered out from the board mounting legs. After repeated insertion and removal of the mating connector into/from the hollow opening, the board mounting legs will be likely to loose or even separate from the PCB.

Hence, it is desired to have an electrical connector solving the problem above.

BRIEF SUMMARY OF THE INVENTION

Accordingly, an object of the present invention is to provide an electrical connector to be firmly mounted on a printed circuit board (PCB) for ensuring proper resistance of the board mounting legs against the force applied thereto.

In order to attain the objective above, an electrical connector comprises an insulative housing, a plurality of contacts retained in the insulative housing and a metal shield enclosing the housing. The insulative housing includes a tongue plate extending forwardly from a front wall thereof. The tongue plate defines a plurality of passageways for receiving the contacts. The metal shield includes a top face, a bottom face, a rear face, and a pair of side faces connecting the top and bottom faces. The bottom face includes a pair of first board mounting legs extending downwardly and slot between the first board mounting legs. The length of the slot is equal to the total length of the first board mounting legs. The rear face includes a pair of second board mounting legs. The major surface of each first board mounting leg is perpendicular to the major surface of each second mounting leg. The first and second board mounting legs are mounted on the PCB for ensuring stable fixation.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
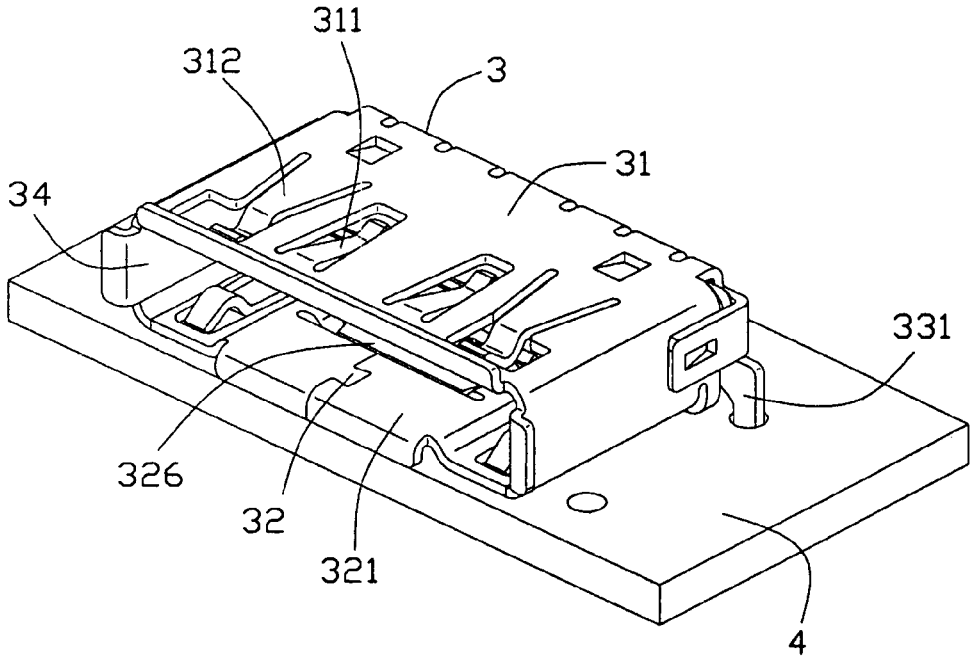
FIG. 1 is a perspective view of an electrical connector mounted on a printed circuit board according to the present invention.
Figure 2:
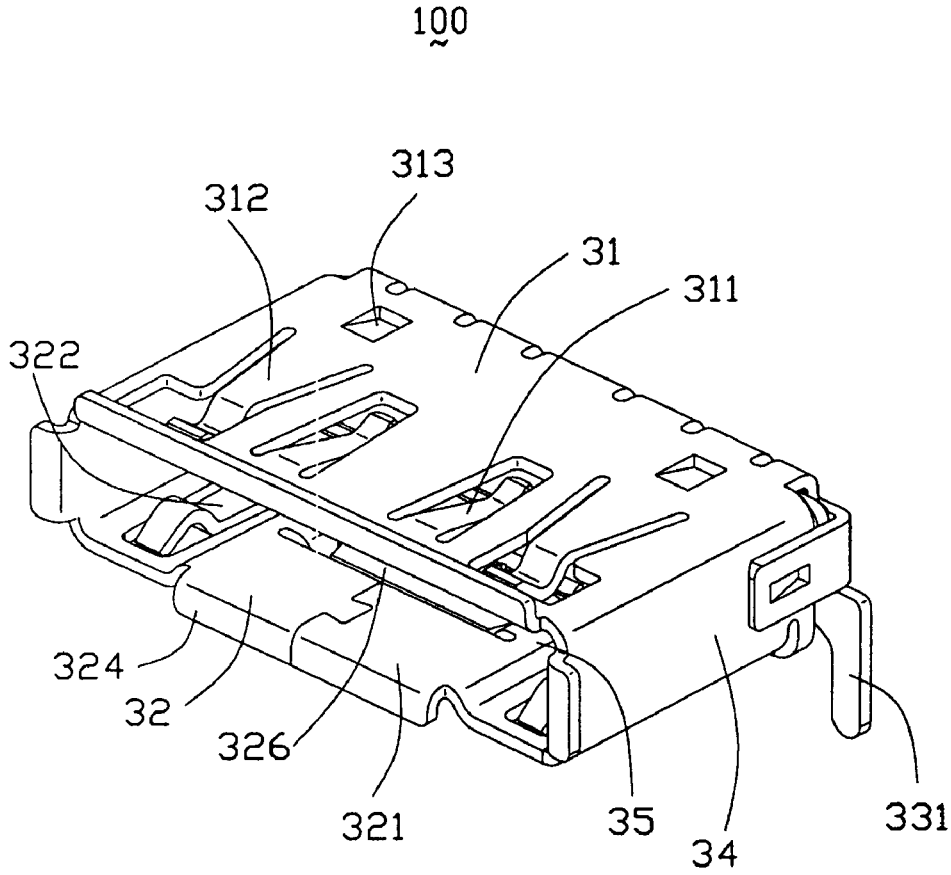
FIG. 2 is a perspective view of the electrical connector according to the present invention.

Reference will now be made in detail to the preferred embodiment of the present invention.

Referring to FIGS. 1 to 5, an electrical connector 100 mounted on a printed circuit board 4 (PCB) comprises an insulative housing 1, a plurality of contacts 2 retained in the insulative housing 1 and a metal shield 3 enclosing the housing 1.

The insulative housing 1 includes a base 11, a tongue plate 12 and a bottom plate 13. The base 11 includes a top wall 111, a front wall 112 and a rear wall 113 disposed opposite to the front wall 112. The top wall 111 defines a pair of recesses 114 in communication of the tongue plate 12. The tongue plate 12 and the bottom plate 13 respectively extend forwardly from upper and lower portions of the front wall 112 wherein the upper surface of the tongue plate 12 is a little lower than the top wall 111. The tongue plate 12 extending along the longitude direction of the housing 1. A plurality of horizontal passageways 121 are disposed in a lower surface of the tongue plate 12 for receiving the contacts 2 therein. The passageways 121 are parallel to one another along the longitude direction of the housing 1 and position in a row. Further, the passageways 121 extend backwardly through the rear wall 113 from which the contacts 2 are assembled. The insulative housing 1 further defines an engaging slit 14 adjacent to the bottom plate 13 for engaging with the shield 3. The bottom plate 13 is trapezia shaped, which includes a contractive front portion 131, a pair of slant lateral walls 132 and a plurality of standoffs 133 extending downwardly for mounting purpose.

Figure 5:
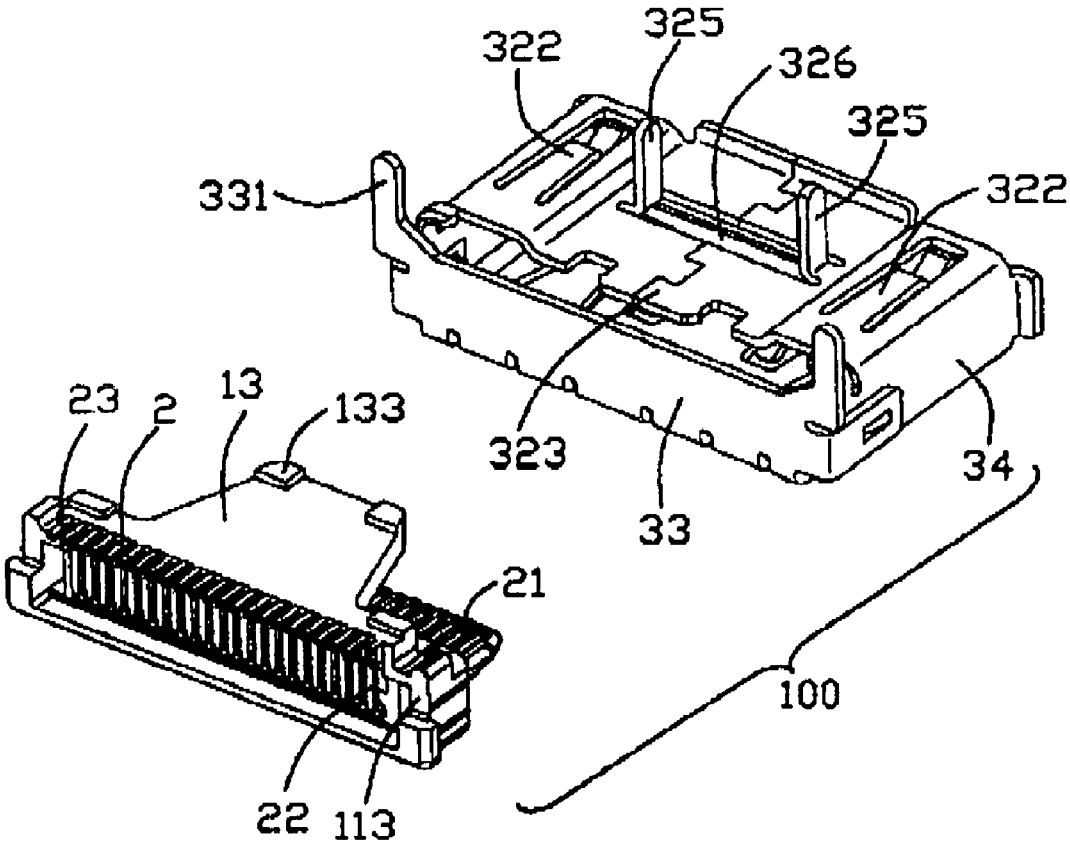
FIG. 5 is another exploded view of the electrical connector in FIG. 3.

Referring to FIG. 5, the contacts 2 are stamped from metal material and of the same configuration. Each contact 2 includes a horizontal engaging portion 21 received in the passageways 121, a connecting portion 22 perpendicular to the engaging portion 21 and a soldering portion 23 extending beyond the housing 1 to be mounted on the PCB 4. The soldering portion 23 is parallel to the engaging portion 21 and perpendicular to the connecting portion 22. All the contacts 2 are disposed in a row along a direction perpendicular to the longitude direction of the insulative housing 1.

Figure 3:
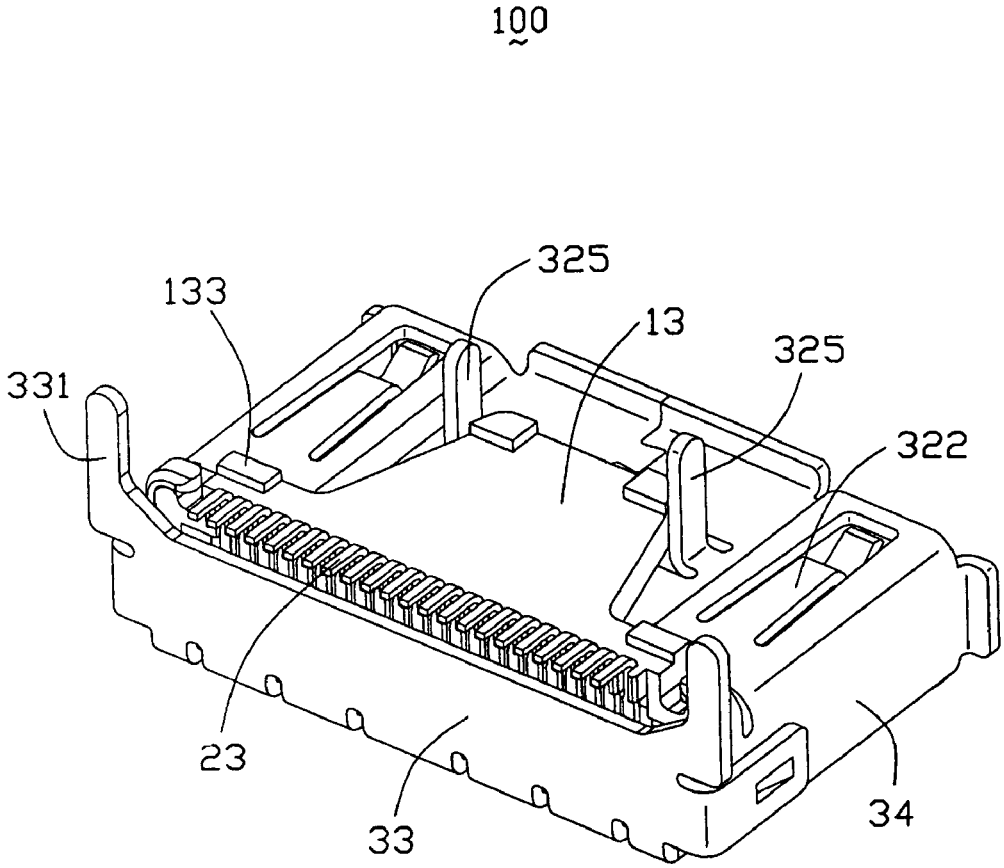
FIG. 3 is another perspective view of the electrical connector.
Figure 4:
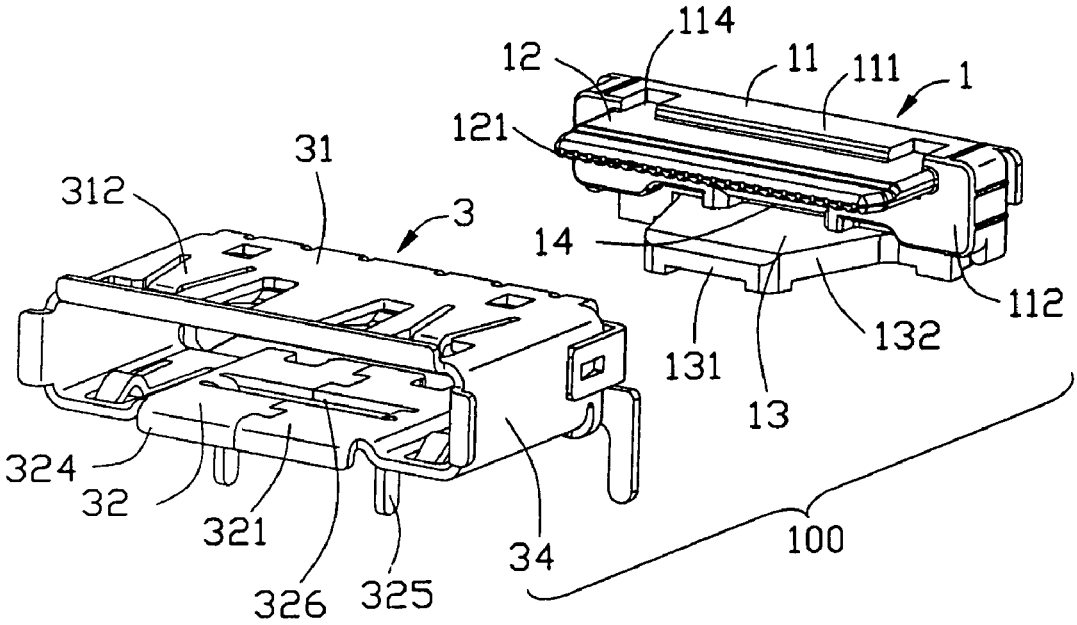
FIG. 4 is an exploded view of the electrical connector in FIG. 2.

The metal shield 3 is stamped from a unitary metal sheet and includes a shroud portion enclosing the tongue plate 12 of the insulative housing 1. The shroud portion includes a top face 31, a bottom face 32, a rear face 33, a pair of side faces 34 connecting the top and bottom faces 31, 32, and a receiving space 35 formed by the peripheral faces 31, 32, 33, 34. The top face 31 has a pair of first and second fingers 311, 312 and a couple of tubers 313 disposed rearward of the second fingers 312 for mating with the recesses 114 of the housing 1. The first fingers 311 are extending in an opposite direction of the second fingers 312. The second fingers 312 are located on the later sides of the first fingers 311. The bottom face 32 includes a middle projecting portion 321 and a pair of third fingers 322 on the lateral sides thereof according to the second fingers 312. The bottom face 32 further includes a pair of lateral sides regions (not labeled) located on two lateral sides of the middle projecting portion 321. The first, second and third fingers 311, 312 and 322 extend inwardly into the receiving space 35 for abutting against the mating connector (not shown). The projecting portion 321 extends into the receiving space 35. The lateral sides regions extend outwardly more than the middle projecting portion 321 along a vertical direction so that the lateral sides regions are downwardly offset from the middle projecting portion 321. As shown in FIG. 3, the bottom plate 13 is located on a bottom side of the middle projecting portion 321 and abuts against the middle projecting portion 321. It is clear that the middle projecting portion 321 and the bottom plate 13 are located on different planes so that the are not coplanar. However, the lateral sides regions extend more outwardly than the middle projecting portion 321 so that they can be essentially coplanar with the bottom plate 13. The projecting portion 321 further defines a tab 323 in the end for mating with the engaging slit 14 of the housing 1, a lip portion 324 opposite to the tab 323, and a pair of first board mountings legs 325 perpendicular to the projecting portion 321. The projecting portion 321 forms a slot 326 between the tab 323 and the lip portion 324 because of the first board mountings legs 325 stamped therefrom. The slot 326 is located between the first board mounting legs 325. The total length of the first board mounting legs 325 are substantially equal to the length of the slot 326. The slot 326 is extending in a horizontal direction perpendicular to the longitude direction of the housing 1. The rear face 33 defines a pair of second board mounting legs 331 extending downwardly and coplanar with the rear face 33. The major surfaces of the first and second board mounting legs 325, 331 are perpendicular to each other. In accordance with the present invention, the first board mounting legs 325 are assembled to the PCB 4 to ensure more stable fixation between the electrical connector 100 and the PCB 4.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted on a printed circuit board (PCB), comprising:

an insulative housing defining a plurality of passageways therein;

a plurality of contacts received in the passageways of the insulative housing; and a metal shield enclosing the insulative housing and comprising a bottom face, a pair of first board mounting legs being stamped from the bottom face and leaving a slot in the bottom face, the first board mounting legs extending downwardly, perpendicular to the bottom face, for being mounted to the PCB, wherein the length of the slot is substantially equal to a total length of the first board mounting legs.

2. The electrical connector according to claim 1, wherein the first board mounting legs respectively include a major surface disposed face to face.

3. The electrical connector according to claim 1, wherein the metal shield includes a top face opposite to the bottom face, a pair of side faces connecting the top and bottom faces, and a receiving space between the side faces.

4. The electrical connector according to claim 3, wherein the top face include a pair of first fingers and a pair of second fingers, the first and second fingers extending into the receiving space wherein the first fingers extend in a direction opposite to that of the second fingers.

5. The electrical connector according to claim 3, wherein the bottom face includes a pair of third fingers facing to the second fingers, said first board mounting legs disposed between the third fingers.

6. The electrical connector according to claim 3, wherein the metal shield includes a rear face perpendicular to the front face, the rear face defining a pair of second board mounting legs, each first board mounting leg having a major surface perpendicular to a major surface of each second board mounting leg.

7. The electrical connector according to claim 6, wherein the second board mounting legs are coplanar with the rear face.

8. The electrical connector according to claim 1, wherein the bottom face includes a middle projection portion with the first board mounting legs disposed therein.

9. The electrical connector according to claim 1, wherein the insulative housing includes a base and a tongue plate extending from the base with the passageways defined therein.

10. The electrical connector according to claim 1, wherein each passageway extend along a longitude direction of the insulative housing, the contacts include engaging portions received in the passageways wherein the engaging portions are disposed in a row along a direction perpendicular to the longitude direction of the insulative housing.

11. The electrical connector according to claim 10, wherein the contacts include soldering portions parallel to the engaging portions and extending beyond the insulative housing.

12. The electrical connector according to claim 1, wherein the insulative housing includes a bottom plate for mating with the bottom face, the first board mounting legs disposed on lateral sides of the bottom plate.

13. An electrical connector assembly comprising:

an insulative housing defining a base with a mating tongue and a bottom plate essentially forwardly horizontally extending therefrom;

a plurality of contacts disposed in the housing with corresponding contacting sections seated upon the mating tongue; and a unitary metallic shell enclosing the housing and including a shroud portion including opposite top and bottom faces and two side faces commonly defining a mating cavity receiving said mating tongue therein, said bottom face including a central region essentially seated upon the bottom plate, two lateral sides regions of the bottom face of the shell being downwardly offset from the central region and essentially coplanar with the bottom plate.

14. The connector assembly as claimed in claim 13, wherein a pair of mounting legs unitarily extend from the bottom face and located by two sides of the bottom plate.

* * * * *